US006819236B2

(12) United States Patent
Kawai et al.

(10) Patent No.: US 6,819,236 B2
(45) Date of Patent: Nov. 16, 2004

(54) VEHICLE MONITORING SYSTEM

(75) Inventors: Makoto Kawai, Wako (JP); Kazuya Tamura, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/804,184

(22) Filed: Mar. 13, 2001

(65) Prior Publication Data

US 2001/0020893 A1 Sep. 13, 2001

(30) Foreign Application Priority Data

Mar. 13, 2000 (JP) ..... P2000-069217

(51) Int. Cl.[7] ..... G08B 1/08

(52) U.S. Cl. ..... 340/539.24; 340/539.11; 340/438; 340/439

(58) Field of Search ..... 340/425.5, 426.13, 340/426.17, 539, 439, 870.16, 426.15, 426.16, 438, 905, 995, 539.11, 539.19, 539.24; 307/10.2; 701/29, 33, 35, 36, 32

(56) References Cited

U.S. PATENT DOCUMENTS

| | | | | |
|---|---|---|---|---|
| 5,157,610 A | * | 10/1992 | Asano et al. | 340/438 |
| 5,539,645 A | * | 7/1996 | Mandhyan et al. | 340/905 |
| 5,657,224 A | * | 8/1997 | Lonn et al. | 701/29 |
| 5,732,074 A | | 3/1998 | Spaur et al. | 370/313 |
| 5,917,405 A | * | 6/1999 | Joao | 340/426 |
| 6,055,468 A | * | 4/2000 | Kaman et al. | 340/439 |
| 6,084,870 A | * | 7/2000 | Wooten et al. | 340/425.5 |
| 6,611,755 B1 | * | 8/2003 | Coffee et al. | 340/438 |

FOREIGN PATENT DOCUMENTS

| | | |
|---|---|---|
| EP | 0918423 | 5/1999 |
| EP | 0955219 | 11/1999 |
| GB | 2263376 | 7/1993 |
| JP | 55-119795 | 9/1980 |
| JP | 60-8590 | 2/1994 |
| JP | 6-339183 | 12/1994 |
| JP | 10-055496 | 2/1998 |
| JP | 10-143782 | 5/1998 |
| JP | 2000-57467 | 2/2000 |
| WO | WO 90/09645 | 9/1990 |
| WO | WO 98/16412 | 4/1998 |
| WO | WO 99/31913 | 6/1999 |

OTHER PUBLICATIONS

Japanese Office Action together with translation dated Nov. 14, 2003.

* cited by examiner

*Primary Examiner*—Van T. Trieu
(74) *Attorney, Agent, or Firm*—Arent Fox, PLLC

(57) ABSTRACT

The vehicle monitoring system comprises: an on-vehicle unit provided in a vehicle, the on-vehicle unit comprising: a vehicle condition monitor for monitoring a condition of the vehicle and outputting vehicle condition data; and an on-vehicle communicator for sending the vehicle condition data output from the vehicle condition monitor; a data server for communicating with the on-vehicle unit, the data server comprising a server communicator for receiving the vehicle condition data sent from the on-vehicle communicator; a storage section for storing the vehicle condition data; and an abnormality determining section for determining whether an abnormality has occurred in the vehicle, based on the vehicle condition data stored in the storage section, and for outputting an abnormality informing signal when the abnormality has occurred in the vehicle.

14 Claims, 11 Drawing Sheets

VEHICLE MONITORING SYSTEM

BACKGROUND OF THE INVENTION

1. Field of the Invention

The present invention relates to a vehicle monitoring system which informs a user of the conditions of the vehicle, and which allows the user, who is far from the vehicle, to operate a part of the vehicle which is, for example, a device for opening and closing a window.

2. Description of the Related Art

There are conventional systems on vehicles which are operated in response to instructions from users such as a remote control engine starter. When the user sends a command using a remote control transmitter to a receiver in the vehicle, the system turns on an ignition switch, and the engine then is started.

In the above conventional system, when the user stops or parks the vehicle and leaves the vehicle, he cannot know the condition of the vehicle. The vehicle may be stolen because the user forgets to close a window, and a battery in the vehicle may go flat because the user forgets to turn off lights.

BRIEF SUMMARY OF THE INVENTION

It is therefore an object of the present invention to provide a vehicle monitoring system by which the user to know the condition of the vehicle even when the user is far from the vehicle.

In the first aspect of the present invention, the vehicle monitoring system comprises: an on-vehicle unit (4) provided in a vehicle (1); and a data server (2) for communicating with the on-vehicle unit. The on-vehicle unit comprises: a vehicle condition monitor (7) for monitoring a condition of the vehicle and outputting vehicle condition data; and an on-vehicle communicator (8) for sending the vehicle condition data output from the vehicle condition monitor, to the data server. The data server comprises: a server communicator (10) for receiving the vehicle condition data sent from the on-vehicle communicator; a storage section (11) for storing the vehicle condition data received by the server communicator; and an abnormality determining section (12) for determining whether an abnormality has occurred in the vehicle based on the vehicle condition data stored in the storage section, and for outputting an abnormality informing signal when the abnormality has occurred in the vehicle.

According to the first aspect of the present invention, when the user is far from the vehicle, the user can check the conditions of the vehicle, and can know the abnormality which has occurred in the vehicle.

The vehicle condition data includes image data, data indicating the position of the vehicle, or the like. The vehicle condition data is transmitted from the on-vehicle communicator of the on-vehicle unit to the server communicator of the data server. The transmission is provided by a telephone line for example. Specifically, the vehicle condition data is transmitted from the on-vehicle communicator (for example, an on-vehicle phone) through a base station near the vehicle by radio. The base station sends the data through the telephone line to the server communicator of the data server.

The data communicator of the data server sends the vehicle condition data to the storage section, and the storage section stores the vehicle condition data in the storage section. Specifically, the storage section stores the vehicle condition data from a predetermined past time to the present.

Even if the vehicle is parked, the vehicle condition data predetermined time is collected in the storage section of the data server.

The abnormality determining section of the data server determines whether an abnormality has occurred in the vehicle, based on the vehicle condition data. For example, when the temperature in the vehicle rapidly increases, or when the head lights have been turned on even after the vehicle has been parked, the section determines that the abnormality has occurred.

In the second aspect of the present invention, the vehicle monitoring system of the first aspect further comprises: a portable communicator (6) for communicating with the data server. The server communicator sends the abnormality informing signal output from the abnormality determining section to the portable communicator.

According to the second aspect of the present invention, when the user is far from the vehicle, the user can check the conditions of the vehicle, and can know the abnormality which has occurred in the vehicle.

Even after the vehicle has been parked, the vehicle condition data for predetermined hours is collected in the storage section of the data server. When the collected vehicle condition data includes an abnormality, the abnormality determines that the abnormality occurs in the vehicle. The report of the determination is sent to the portable communicator (for example, a cellular phone) of the user. The portable communicator gives an alarm, and the user can know the abnormality in the vehicle.

In the third aspect of the present invention, when the portable communicator sends a data request signal from the portable communicator to request sending of the vehicle condition data, the server communicator of the vehicle monitoring system of the second aspect sends the vehicle condition data from the storage section to the portable communicator.

According to the third aspect of the present invention, the user can obtain the vehicle condition data from the storage section, and can check the conditions of the vehicles if necessary.

In the fourth aspect of the present invention, the vehicle monitoring system of the second aspect further comprises a driver (9) for driving a part of the vehicle. The portable communicator sends a settling command signal to settle the abnormality, through the server communicator and the on-vehicle communicator to the driver, and the driver drives the part of the vehicle based on the sent settling command signal.

According to the fourth aspect of the present invention, the user who is far from the vehicle can operate the part of the vehicle to settle the abnormality.

In the fifth aspect of the present invention, the vehicle monitoring system of the fourth aspect further comprises a setting section (17) for setting a command to settle the abnormality, in advance. The setting section sends a settling command signal corresponding to the abnormality informing signal sent from the abnormality determining section, through the server communicator to the on-vehicle communicator.

According to the fifth aspect of the present invention, when the user sets the manner to settle the abnormality, the server communicator of the data server sends the settling command signal through the on-vehicle communicator of the on-vehicle unit to the driver. The driver automatically settles the abnormality. For example, the driver automatically turns off the head lights which have been turned on after the vehicle was parked.

In the sixth aspect of the present invention, the vehicle monitoring system comprises: an on-vehicle unit provided in a vehicle; and a data server for communicating with the on-vehicle unit. The on-vehicle unit comprises: a vehicle condition monitor for monitoring a condition of the vehicle and outputting vehicle condition data; and a storage section (31) for storing the vehicle condition data output from the vehicle condition monitor; an abnormality determining section (32) for determining whether an abnormality has occurred in the vehicle, based on the vehicle condition data stored in the storage section, and for outputting an abnormality informing signal when the abnormality has occurred in the vehicle; and an on-vehicle communicator for sending the abnormality informing signal output from the abnormality determining section, to the data server. The data server comprises a server communicator for receiving the vehicle condition data sent from the on-vehicle communicator.

In the seventh aspect of the present invention, the vehicle monitoring system of the six aspect further comprises: a portable communicator for communicating with the data server. The server communicator sends the abnormality informing signal output from the on-vehicle communicator, to the portable communicator.

In the eighth aspect of the present invention, the server communicator in the vehicle monitoring system of the seventh aspect sends the data request signal to the on-vehicle communicator in response to a data request signal from the portable communicator to request sending of the vehicle condition data. The on-vehicle communicator sends the vehicle condition data from the storage section through the server communicator to the portable communicator in response to the data request signal.

In the ninth aspect of the present invention, the vehicle monitoring system of the seventh aspect further comprises: a driver for driving a part of the vehicle. The portable communicator sends a settling command signal to settle the abnormality, through the server communicator and the on-vehicle communicator to the driver. The driver drives the part of the vehicle based on the sent settling command signal.

In the tenth aspect of the present invention, the vehicle monitoring system of the ninth aspect further comprises: a setting section for setting a command to settle the abnormality, in advance. The setting section sends a settling command signal corresponding to the abnormality informing signal sent from the abnormality determining section, communicator to the driver.

According to the present invention, the on-vehicle unit transmits the vehicle condition data to the data server, the user who is far from the vehicle can know the conditions of the vehicle, and can know the abnormality in the vehicle.

When the abnormality of the vehicle is detected, the data server transmits the abnormality informing signal, the user can receive the signal even when the user is far from the vehicle.

At that time, even when the cellular phone of the user is outside the service area in which the radio waves from a base station can reach, or even when the cellular phone has been turned off, the vehicle condition data can be stored in the data server. When the cellular phone enters the service area, or when the cellular phone is turned on, the data server informs the user of the abnormality.

The vehicle condition data has been stored in the data server, even when the vehicle is broken.

The user can reliably know the abnormality of the vehicle.

The cellular phone sends the data request signal to the data server, and the data server then sends the vehicle condition data. The user can obtain the vehicle condition data if necessary, and can check the conditions of the vehicle.

Thus, even when the user leaves the vehicle, the user can monitor the conditions of the vehicle, and feels easy.

Further, the user who is far from the vehicle can resolve the abnormality.

For example, the user can open or close the windows, and the convertible top, can lock or unlock the doors, can operate the air conditioner, and can turn off the lights. Thus, the invention prevents the rapidly rising of the temperature in the cabin because the user can open the windows. Further, the present invention prevents the vehicle from being stolen, and prevents the cabin from getting wet by rain when the weather suddenly changes, because the opened windows, the opened convertible top, or the unlocked door can be closed or locked. Further, the present invention prevents the battery from going flat because the lights can be turned off.

Further, the driver automatically settle the abnormality in response to the command.

For example, even when the lights have been turned on, the driver automatically turns off the lights.

The communication may be established even when the abnormality has occurred in the vehicle. Thus, the communication expense can be reduced.

DETAILED DESCRIPTION OF THE INVENTION

The embodiments of the present invention will be explained. In the first embodiment, the system on the vehicle periodically communicates with a data server located in a specific position outside the vehicle. In the second embodiment, the system on the vehicle communicates with the data server only when an abnormality has occurred in the vehicle. In the third embodiment, the system on the vehicle communicates with a cellular phone when an abnormality has occurred in the vehicle.

Figure 1:
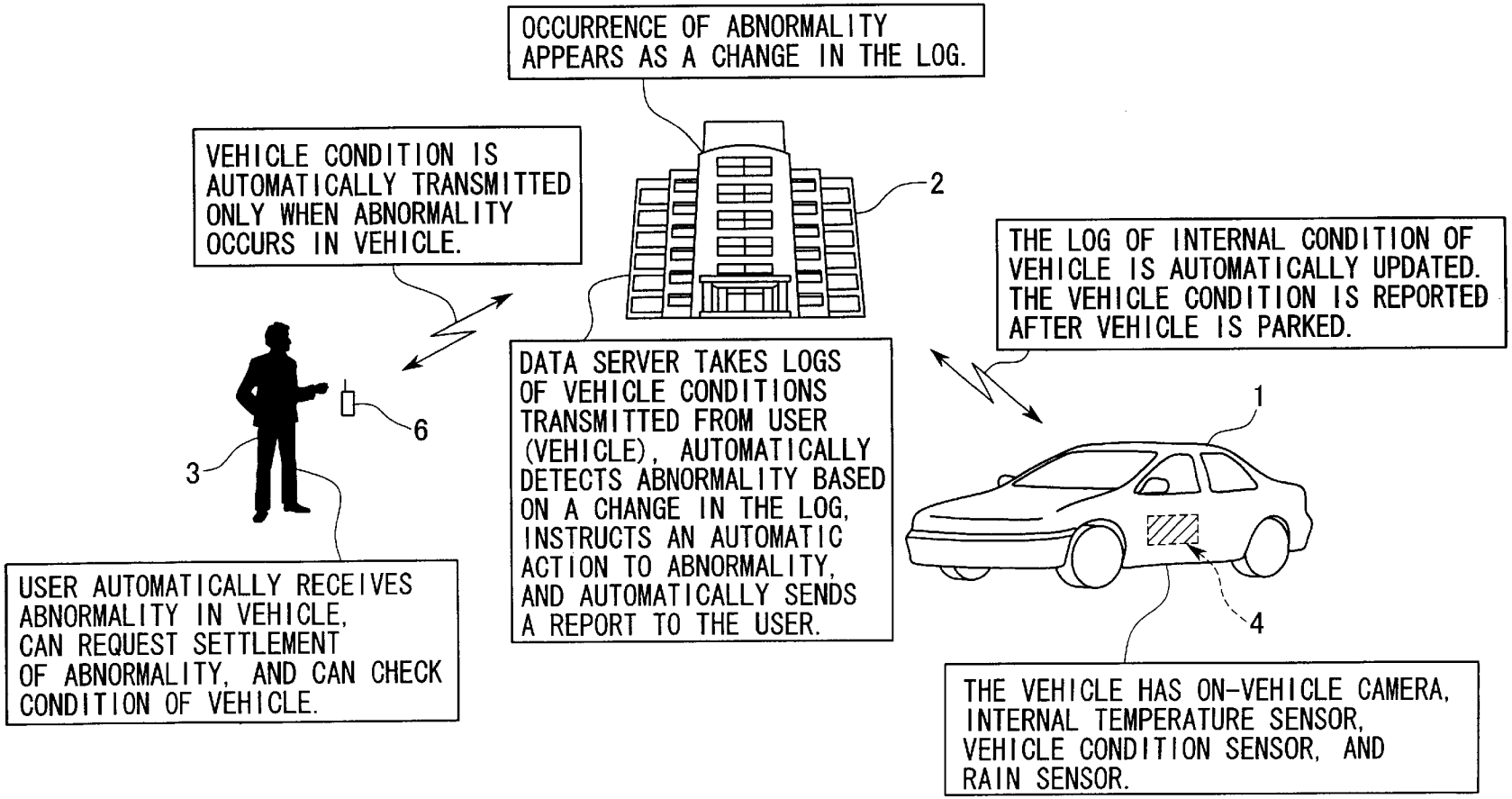
FIG. 1 is a schematic diagram showing the vehicle monitoring system of the first embodiment of the present invention.

The first embodiment of the present invention will be explained. FIG. 1 is a schematic diagram showing the structure of the vehicle monitoring system of the first embodiment. A vehicle 1 is equipped with an on-vehicle unit 4 for detecting the condition of the vehicle 1. The on-vehicle unit 4 includes an on-vehicle sensor for detecting the condition of the vehicle 1. The on-vehicle sensor is, e.g., an internal monitoring camera, an external monitoring camera, an internal temperature sensor, or an internal humidity sensor shown in FIG. 3.

The on-vehicle unit 4 on the vehicle 1 periodically sends the vehicle condition data indicating the condition of the vehicle 1 to a data server 2 located at a specific position outside the vehicle. The data server 2 stores the vehicle condition data units, sent from the on-vehicle unit 4 in a predetermined period, in the order of the time of receipt, and detects an abnormality in the vehicle 1 based on the variation of the stored vehicle condition data. When an abnormality has been detected in the vehicle 1, the data server 2 sends an abnormality informing signal to a cellular phone 6 of the user 3. The user 3 who is far from the vehicle 1 can thus know the abnormality in the vehicle 1.

The user 3 who has been informed about the abnormality in the vehicle 1 inputs a command for settling the abnormality into the cellular phone 6. The cellular phone 6 sends the command to the on-vehicle unit 4 on the vehicle 1, and the on-vehicle unit 4 settles the abnormality.

Even when the data server 2 does not communicate with the user 3, the user 3 may send a request signal to the data server 2 if necessary, to direct the data server 2 to send the vehicle condition data to the cellular phone 6. When the user 3 sends the request signal from the cellular phone 6 to the data server 2, the data server 2 returns the vehicle condition data. The user 3 who is far from the vehicle 1 can know the condition of the vehicle 1 at any time.

When the automatic operation for settling the abnormality in the vehicle 1 is preset in the data server 2, the data server 2 automatically sends the command for settling the abnormality to the on-vehicle unit 4 without any inquiry to the user 3, and the on-vehicle unit 4 immediately settles the abnormality.

After the abnormality has been settled, the user may be informed of the settlement of the abnormality.

Figure 2:
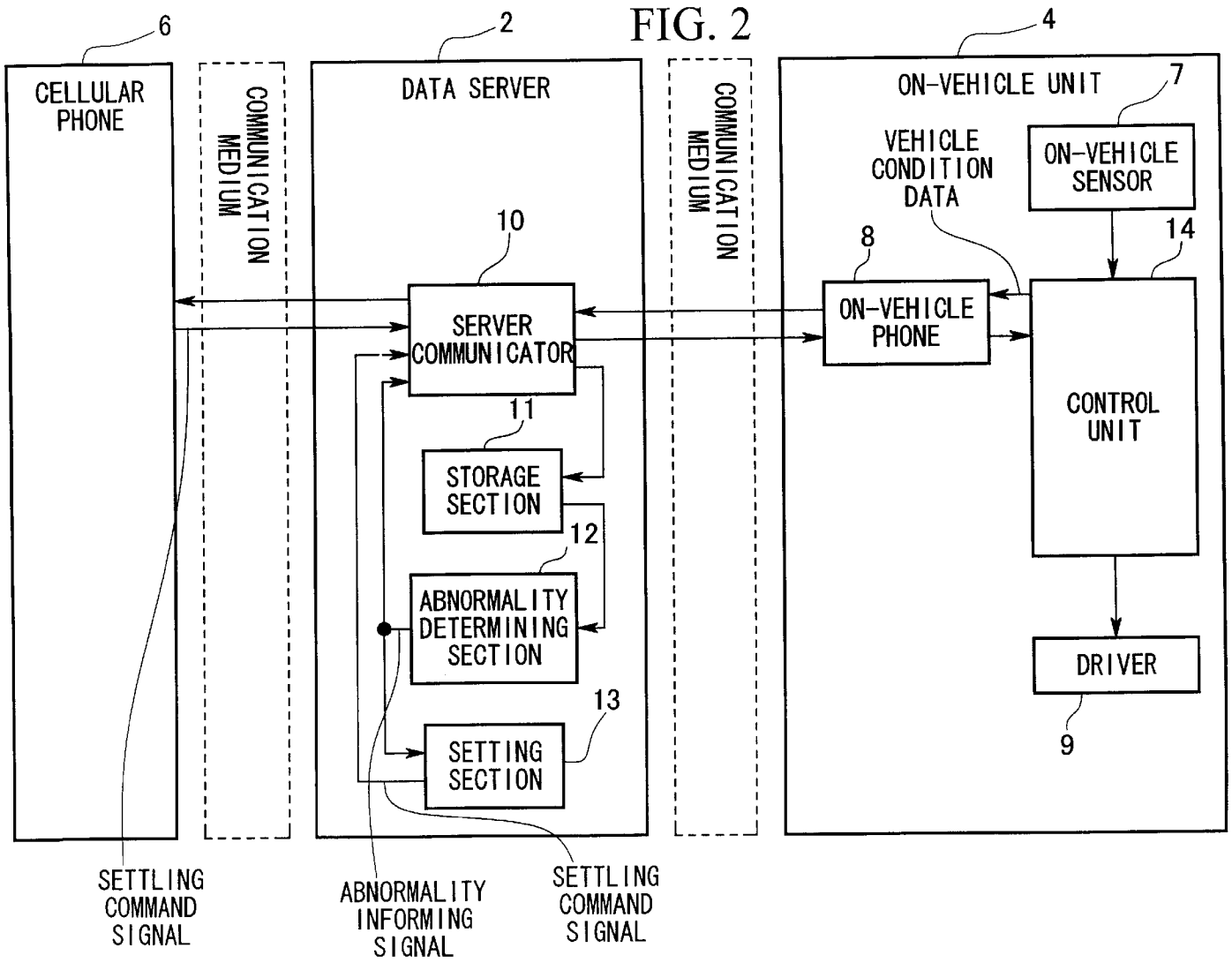
FIG. 2 is a diagram showing the vehicle monitoring system of the first embodiment in detail.

FIG. 2 is a diagram showing the structure of the vehicle monitoring system of the embodiment in detail, in particular, the internal structures of the on-vehicle unit 4, the data server 2, and the cellular phone 6 constituting the vehicle monitoring system.

The on-vehicle unit 4 comprises an on-vehicle sensor 7, a control unit 14, an on-vehicle phone 8, and a driver 9. The on-vehicle sensor 7 detects the condition of the vehicle 1, and outputs the results of the detection as the vehicle condition data. The control unit 14 sends the vehicle condition data output from the on-vehicle sensor 7, to the on-vehicle phone 8 which is described below. The on-vehicle phone 8 transmits the vehicle condition data sent from the control unit 14, to the data server 2 through a communication means. Further, the on-vehicle phone 8 receives the command signal for settling the abnormality in the vehicle transmitted from the data server 2. The driver 9 receives the settling command signal from the on-vehicle phone 8 through the control unit 14, and drives a specific device on the vehicle 1 based on the settling command signal to settle the abnormality.

The data server 2 comprises a server communicator 10, a storage section 11, an abnormality determining section 12, and a setting section 13. The server communicator 10 receives the vehicle condition data transmitted from the on-vehicle phone 8 in the on-vehicle unit 4, through a communication means. The storage section 11 stores the vehicle condition data received by the server communicator 10. The abnormality determining section 12 determines whether an abnormality has occurred in the vehicle 1, based on the vehicle condition data stored in the storage section 11. When the abnormality is detected in the vehicle 1, the abnormality determining section 12 sends an abnormality informing signal to the server communicator 10, or a setting section 13 which is describe below. The methods for settling various abnormalities in the vehicle are preset in the setting section 13. When receiving the abnormality informing signal from the abnormality determining section 12, the setting section 13 sends the method for settling the abnormality indicated by the received abnormality informing signal, as the settling command signal to the server communicator 10.

The cellular phone 6 is carried by the user 3 of the vehicle 1, receives the abnormality informing signal sent from the server communicator 10 in the data server 2 through the communication means, and informs the user of the abnormality in the vehicle 1. The user 3 operates the cellular phone 6 to input the command for settling the abnormality in the vehicle 1. Then, the cellular phone 6 transmits the settling command signal to the server communicator 10 in the data server 2.

Figure 3:
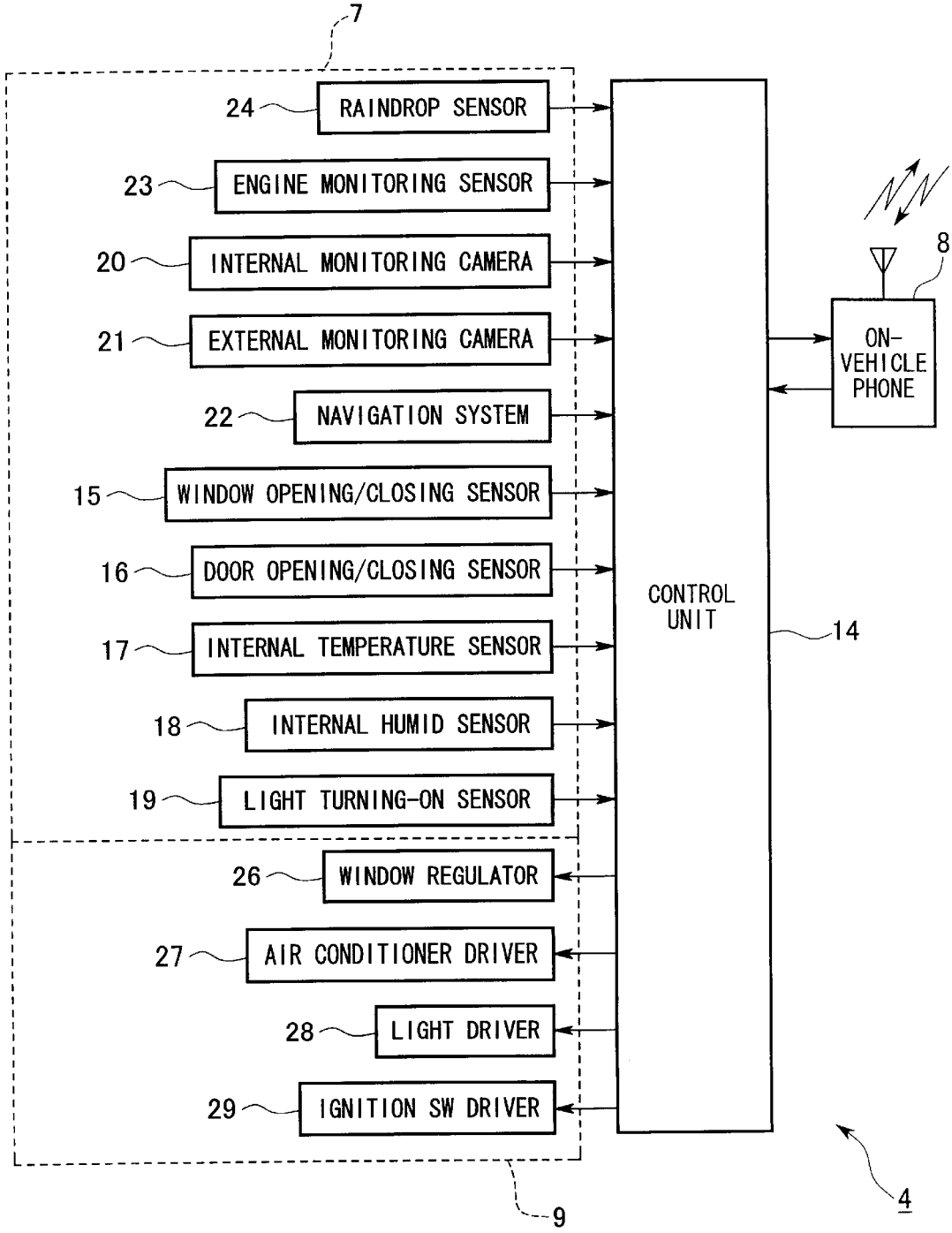
FIG. 3 is a diagram showing the internal structure of the on-vehicle unit of the vehicle monitoring system of the first embodiment.

FIG. 3 is a diagram showing the detailed internal structure of the on-vehicle unit 4 which constitutes the vehicle monitoring system of the embodiment. The on-vehicle unit 4 shown in FIG. 3 comprises the on-vehicle sensor 7, the on-vehicle phone 8, the driver 9, and the control unit 14.

The on-vehicle sensor 7 has a window opening/closing sensor 15, a door opening/closing sensor 16, an internal temperature sensor 17, an internal humidity sensor 18, a light turning-on sensor 19, an internal monitoring camera 20, an external monitoring camera 21, a navigation system 22, an engine monitoring sensor 23, and a raindrop sensor 24.

The window opening/closing sensor 15 detects whether the window of the vehicle 1 is opened or closed, and detects the degree of opening when the window is opened. Further, when the vehicle 1 has a sun-roof or a convertible top, it is detected whether the sun-roof or the convertible top is opened or closed. The door opening-closing sensor 16 detects whether the doors of the vehicle 1 are opened or closed, and detects whether the doors are locked when the doors are closed.

The internal temperature sensor 17 measures the temperature inside the vehicle 1, and the internal humidity sensor 18 measures the humidity inside the vehicle 1. The light turned-on sensor 19 detects whether the lights of the vehicles, which includes head lights, are turned on or off. The internal monitoring camera 20 receives images inside the vehicle, and monitors the conditions inside the vehicle, for example, detecting a person inside the vehicle. The external monitoring camera 21 receives images outside the vehicle, and monitors the conditions around the vehicle, for example, detecting rain, or criminal activity.

The navigation system 22 detects the position of the vehicle 1. The engine monitoring sensor 23 monitors the condition of the engine on the vehicle 1. The raindrop sensor 24 detects raindrops on the vehicle 1 in order to determine whether it is raining.

The vehicle condition data output from the on-vehicle sensor 7 includes image data, vehicle position data, and other data relating the condition of the vehicle.

The driver 9 has a window regulator 26, an air conditioner driver 27, a light driver, and an ignition switch driver 29.

The window regulator 26 drives an actuator for opening or closing the windows in order to open or close the windows of the vehicle 1. The air conditioner driver 27 turns on or off an air conditioner of the vehicle 1. The light driver 28 turns on or off the lights which includes the head lights. The ignition switch driver 29 operates an ignition switch of the vehicle 1.

The control unit 14 receives various data units relating the conditions of the vehicle detected by the on-vehicle sensor 7, combines the data into a single vehicle condition data unit, and sends the data unit to the on-vehicle phone 8. The control unit 14 receives the command signal to settle the abnormality in the vehicle 1 from the on-vehicle phone 8, and sends the settling command signal to the driver 9.

Figure 4:
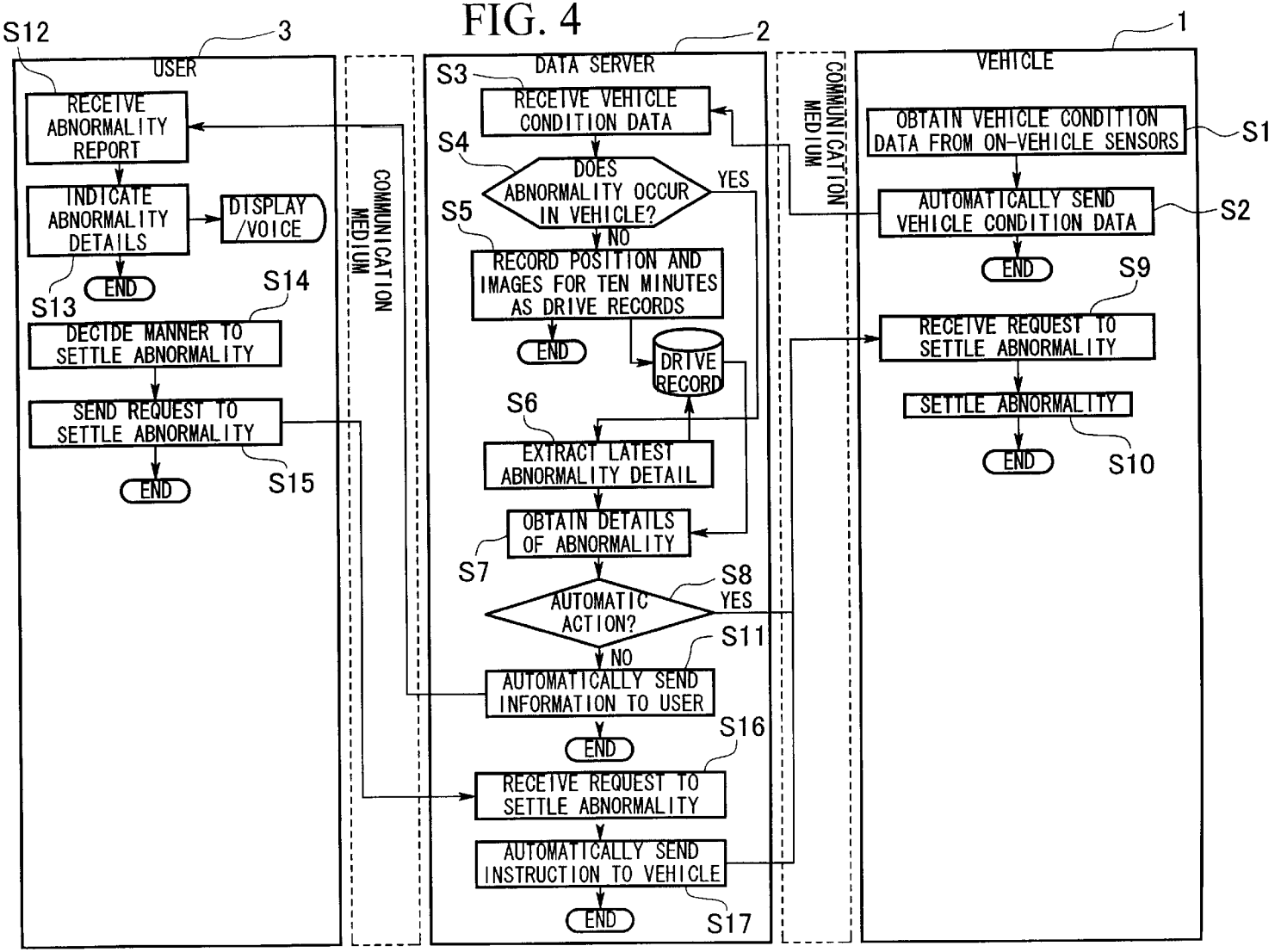
FIG. 4 is a flowchart showing the operation of the first embodiment of the present invention.

The operation of the embodiment will now be explained with reference to the flowchart of FIG. 4. Reference characters such as S1 in the following description denote steps in the flowchart.

The sensor 7 on the vehicle 1 detects the conditions of the vehicle 1 at a predetermined interval, and outputs the vehicle condition data (step S1). For example, the navigation system 22, which is one of the on-vehicle sensors 7, detects the position of the vehicle 1 at one second intervals. The internal temperature sensor 17 detects the temperature inside the vehicle 1 at a predetermined interval. The internal humidity sensor 18 measures the humidity inside the vehicle 1 at a predetermined interval. The internal monitoring camera 20 receives the image inside the vehicle 1. It is determined, based on the received image, whether a person is within the cabin of the vehicle 1. The external monitoring camera 21 receives the image outside the vehicle 1. Rain or criminal activity is detected based on the received image. The raindrop sensor 24 detects raindrops on the vehicle 1, and determines whether it is raining.

The sensors detects the conditions of the portions of the vehicle. The sensors are the window opening/closing sensor 15, the light turning-on sensor 19, the door opening/closing sensor 16, and the engine monitoring sensor 23. The window opening-closing sensor 15 detects the opening or closing of the window. Further, when the vehicle 1 has a sun-roof or a convertible top, the opening or closing of the sun-roof or the convertible top is detected. The light turned-on sensor 19 detects whether the lights, which includes the head lights, are turned on or off. The door opening/closing sensor 16 detects the opening or closing of the doors, and the locked or unlocked doors. The engine monitoring sensor 23 detects the conditions of the engine of the vehicle 1.

The various data units obtained by the on-vehicle sensor 7 are input to the control unit 14. The control unit 14 combines the input data units into the single vehicle condition data unit, and sends the data unit to the on-vehicle phone 25.

The on-vehicle phone 25 transmits the vehicle condition data unit to the base station near the vehicle 1 (step S2). The vehicle condition data unit is transmitted from the base station via the telephone line to the data server 2 connected to the telephone line. The transmission of the vehicle condition data from the vehicle 1 to the data server 2 is periodically conducted. In an emergency situation, for example, in case of sudden rain, the emergency information is transmitted from the vehicle 1 to the data server 2 regardless of the interval of the transmission.

An unchanged data unit in the various data units contained in the vehicle condition data unit is not transmitted, and only the changed data units are transmitted. For example, when the lights have been turned off and are not yet turned on, the data unit indicating the condition of the lights is omitted from the transmitted vehicle condition data unit.

The server communicator 10 in the data server 2 receives the vehicle condition data unit transmitted from the vehicle 1 via the telephone line (step S3).

The abnormality determining section 12 determines whether the abnormality has occurred in the vehicle 1, based on the vehicle condition data unit received by the server communicator 10 (step S4). The abnormality is, for example, a sudden variation in the internal temperature, or the continuation of the on-state of the head lights after the vehicle has been parked.

When no abnormality is detected in the vehicle, the vehicle condition data unit received by the server communicator 10 is stored in the storage section 11 as a drive record (step S5). The storage section 11 stores the drive records for the previous ten minutes. The drive records include the position of the vehicle 1 and the images inside and outside the vehicle 1.

When the abnormality is detected in the vehicle in step S4, the abnormality determining section 12 requests the storage section 11 to output the stored drive records (step S6). The storage section 11 sends the requested drive records to the abnormality determining section 12, which then determines the details of the abnormality based on the drive records, and then outputs the abnormality informing signal indicating the results of the determination (step S7).

Then, the setting section 13 determines whether an automatic action to the abnormality has been set (step S8). When the automatic action to the abnormality has been set, the setting section 13 receives the abnormality informing signal corresponding to the details of the abnormality determined by the abnormality determining section 12, and sends the settling command signal corresponding to this abnormality informing signal to the server communicator 10. The server communicator 10 transmits the settling command signal to the on-vehicle phone 8 in the vehicle 1.

The on-vehicle 8 in the vehicle 1 receives the settling command signal transmitted from the server communicator 10 in the data server 2 (step S9), and sends the received settling command signal to the driver 9 via the control unit 14. The driver 9 operates the corresponding portion of the vehicle 1 based on the settling command signal in order to settle the abnormality (step S10).

When the automatic response to the abnormality has not been set in step S8, the server communicator 10 receives the abnormality informing signal which has been output from the abnormality determining section 12 and contains the information relating the abnormality in the vehicle, from the abnormality determining section 12, and sends the abnormality informing signal to the cellular phone 30 of the user 3 (step S11). The information relating the abnormality in the vehicle includes, for example, the position of the vehicle, the condition inside and outside the vehicle, and the conditions of the parts (the headlights, the doors, etc.) of the vehicles.

When the connection to the cellular phone 30 of the user 3 is not established, the server communicator 10 repeats the transmission of the signal until the connection has been established.

For example, when the window opening/closing detecting sensor 15, which is one of the on-vehicle sensors 7 in the vehicle 1, detects that the window of the vehicle 1 is open, and when the external monitoring camera 21 detects rain, the information indicating these conditions is transmitted as the vehicle condition data from the on-vehicle phone 8 to the server communicator 10 in the data server 2. Then, the abnormality determining section 12 in the data server 2 detects the abnormality, and outputs the abnormality informing signal. The output abnormality informing signal is transmitted from the server communicator 10 to the cellular phone 30 of the user 3.

The cellular phone 30 of the user 3 receives the abnormality informing signal transmitted from the data server 2 (step S12), and informs the user 3 of the details of the abnormality by voice, or texts, or images on a display (step S13). Thus, the user 3 can know the abnormality of the vehicle 1.

The user 3 who has been informed about the abnormality decides the manner to settle the abnormality depending on the details of the abnormality (step S14). Then, the user 3 inputs the manner to settle the abnormality into the cellular phone 30, and the cellular phone 30 transmits the command signal to settle the abnormality, corresponding to the manner specified by the user, to the server communicator 10 (step S15).

On receiving the settling command signal from the cellular phone 30 (step S16), the server communicator 10 transmits the settling command signal to the on-vehicle phone 8 in the vehicle 1.

On receiving the settling command signal from the server communicator 10 in the data server 2 (step S9), the on-vehicle phone 8 sends the command signal to the driver 9 via the control unit 14. The driver 9 then operates the corresponding parts of the vehicle 1 depending on the command signal, in order to settle the abnormality (step For example, it is assumed that the user 3 decides to close the window of the vehicle 1 according to the details of the abnormality. Then, the user 3 inputs the command to close the window of the vehicle 1 into the cellular phone 30. This settling command signal is transmitted from the cellular phone 30 to the server communicator 10, and is transmitted to the on-vehicle phone 8 in the vehicle 1. The on-vehicle phone 8 sends the settling command signal to the driver 9 via the control unit 14. Then, the driver 9 operates the actuator for opening and closing the window according to the settling command signal, in order to close the window. Thus, the abnormality can be settled.

The user may set the automatic operation for settling the abnormality in the setting section 13 in the data server 2, in advance. In this case, when the abnormality determining section 12 detects the abnormality, the command to close the window is not sent to the user 3, but is directly sent to the vehicle 1. Thus, the window of the vehicle 1 can be closed.

When the user 3 who is far from the vehicle 1 wishes to know the conditions of the vehicle 1, the users can access the storage section 11 of the data server 2 using the cellular phone 30, and can read the latest vehicle condition data stored in the storage section 11.

As the results of the check, when an abnormality is found in the vehicle, the settling command signal to settle the abnormality can be transmitted from the cellular phone 6 to the data server 2. On receiving the settling command signal, the data server 2 transmits the settling command signal to the on-vehicle phone 8. On receiving the settling command signal, the on-vehicle phone 8 sends the settling command signal to the driver 9, and the driver 9 settles the abnormality. For example, the driver 9 drives actuates the motor for opening or closing the window of the vehicle 1, in order to close the window.

The on-vehicle unit 4 which has settled the abnormality can send the signal indicating that the abnormality has been settled, to the cellular phone 6 of the user 3 via the data server 2.

Next, the second embodiment of the present invention will now be explained. the on-vehicle unit in the second embodiment communicates with the data server only when the abnormality has occurred in the vehicle.

Figure 5:
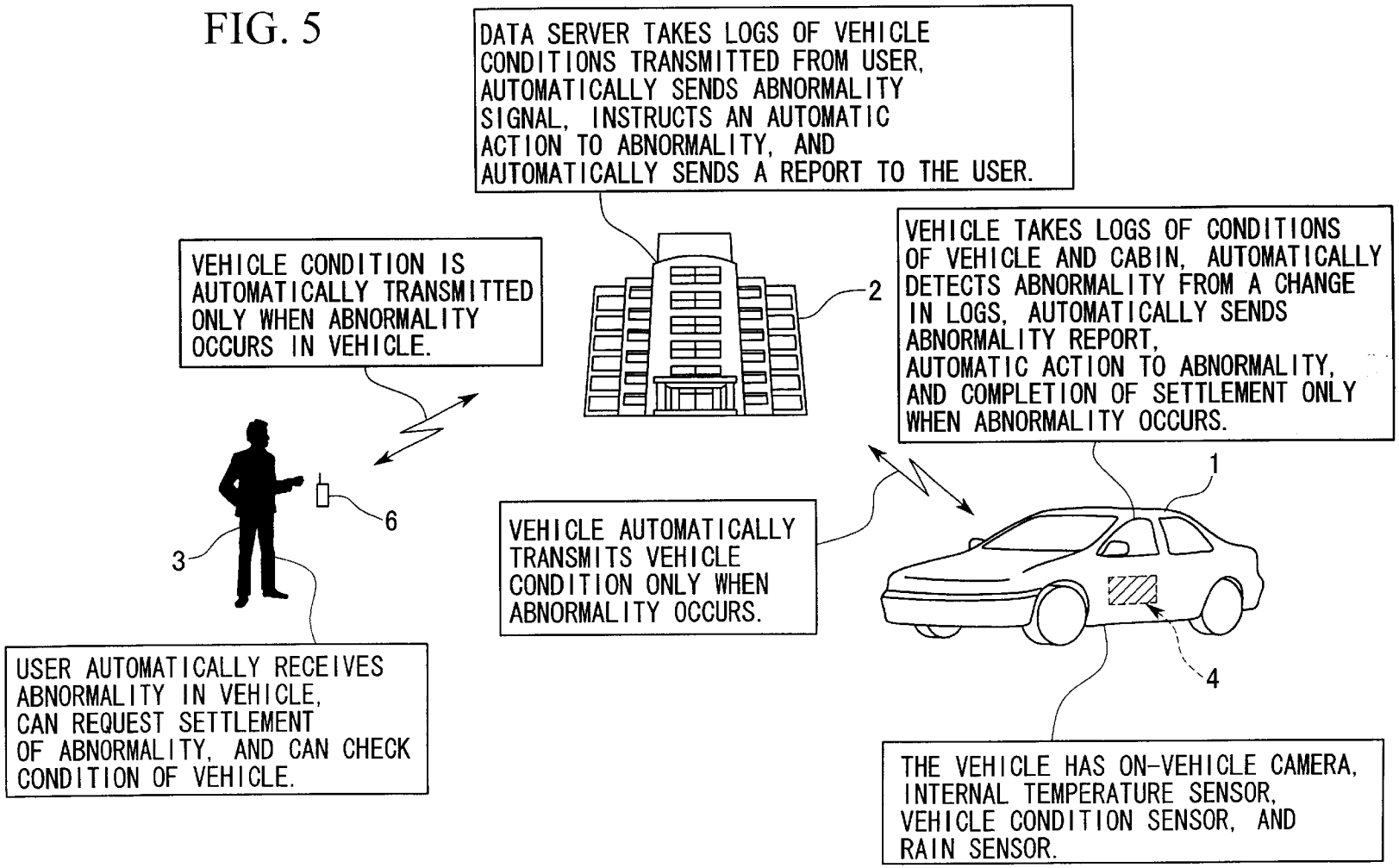
FIG. 5 is a diagram showing the vehicle monitoring system of the second embodiment of the present invention.

FIG. 5 is a schematic diagram showing the vehicle monitoring system of the present invention. The vehicle monitoring system of this embodiment comprises an on-vehicle unit 4 on a vehicle 1, a data server 2 provided outside the vehicle, and a cellular phone 6 of a user 3. The on-vehicle unit 4 on the vehicle 1 communicates with the data server 2 only when the abnormality has occurred in the vehicle 1.

Figure 6:
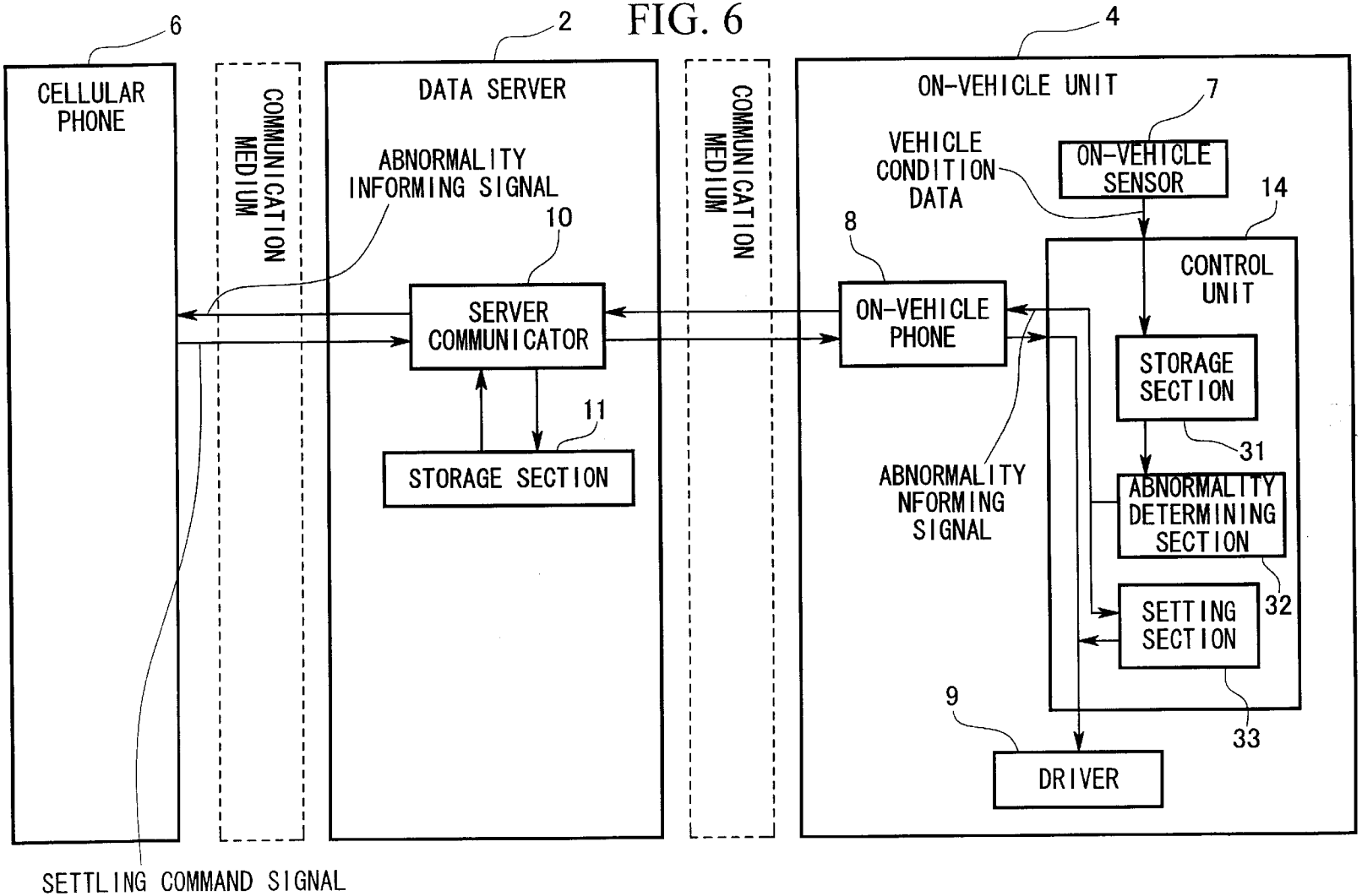
FIG. 6 is a diagram showing the vehicle monitoring system of the second embodiment in detail.

FIG. 6 is a diagram showing the details of the vehicle monitoring system of the embodiment, and showing the details of the internal structures of the on-vehicle unit 4, the data server 2, and the cellular phone 6. The difference from the first embodiment is that the control unit 14 in the on-vehicle unit 4 has a storage section 31, an abnormality determining section 32, and a setting section 33. The storage section 31 stores data indicating the conditions of the vehicle within a predetermined period. The abnormality determining section 32 determines whether an abnormality has occurred in the vehicle 1, based on the vehicle condition data stored in the storage section 31, and outputs an abnormality informing signal when the abnormality is detected in the vehicle 1. The setting section 33 sets the manners to settle the abnormality, in advance.

Figure 7:
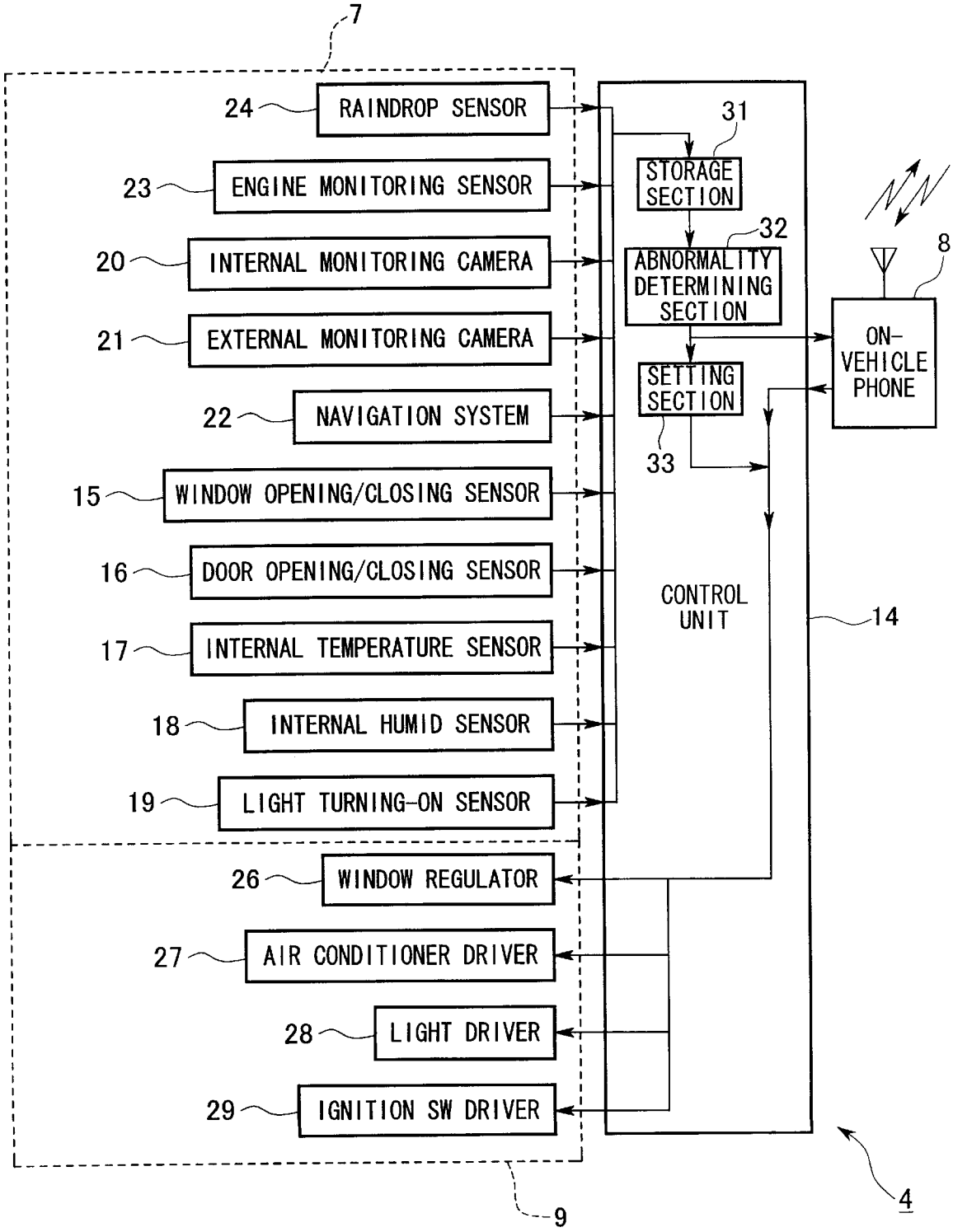
FIG. 7 is a diagram showing the internal structure of the on-vehicle unit of the vehicle monitoring system of the second embodiment.

FIG. 7 is a diagram showing the detailed internal structure of the on-vehicle unit 4 which is a component of the vehicle monitoring system of the second embodiment. The difference from the first embodiment is that the control unit 14 has the storage section 31, the abnormality determining section 32, and the setting section 33. The storage section 31 stores data indicating the conditions of the vehicle during a predetermined period. The abnormality determining section 32 determines whether an abnormality has occurred in the vehicle 1, based on the vehicle condition data stored in the storage section 31, and outputs an abnormality informing signal when the abnormality is detected in the vehicle 1. The setting section 33 sets the manners to settle the abnormality, in advance.

Figure 8:
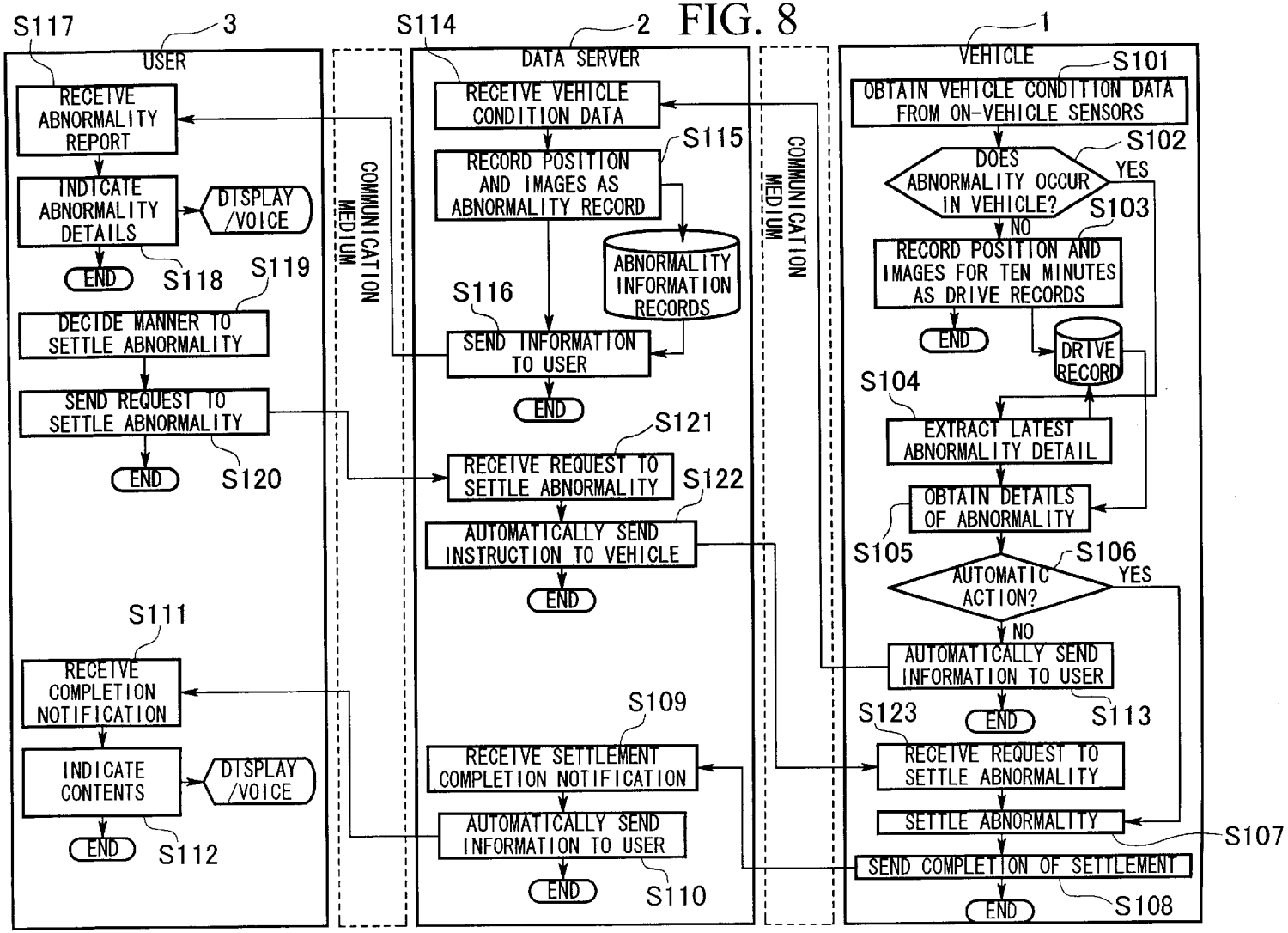
FIG. 8 is a flowchart showing the operation of the second embodiment of the present invention.

The operation of the second embodiment will now be explained with reference to the flowchart of FIG. 8. Reference characters such as SI in the following description denote steps in the flowchart.

The sensor 7 on the vehicle 1 detects the conditions of the vehicle 1 at a predetermined interval, and outputs the vehicle condition data (step S101). The various data units obtained by the on-vehicle sensor 7, which are the vehicle condition data, are input to the control unit 14. The storage section 31 of the control unit 14 stores the input vehicle condition data.

The abnormality determining section 32 in the control unit 14 determines whether the abnormality has occurred in the vehicle 1, based on the vehicle condition data unit stored in the storage section 31 (step S102).

When no abnormality is detected in the vehicle, the vehicle condition data unit is stored in the storage section 31 as a drive record (step S103). The storage section 31 stores the drive records for the previous ten minutes. The drive records include the position of the vehicle 1 and the images inside and outside the vehicle 1.

When the abnormality is detected in the vehicle in step S102, the abnormality determining section 32 requests the storage section 31 to output the stored drive records (step S104). The storage section 31 sends the requested drive records to the abnormality determining section 32, which then determines the details of the abnormality based on the drive records, and then outputs the abnormality informing signal indicating the results of the determination (step S105).

Then, the setting section 33 determines whether an automatic response to the abnormality has been set (step S106). When the automatic response to the abnormality has been set, the setting 33 sends an abnormality informing signal corresponding to the abnormality detected by the abnormality determining section 32, and sends a settling command signal corresponding to the abnormality informing signal, to the driver 9. The driver 9 settles the abnormality based on the settling command signal (step S107).

The driver 9, which has completed the settlement of the abnormality, outputs a signal indicating the completion of the settlement, and this settlement completion notification is transmitted from the on-vehicle phone 8 to the data server 2 (step S108). The communicator 10 in the data server 2 receives the settlement completion notification from the on-vehicle phone 8 in the on-vehicle unit 4 (step S109), and is transmitted to the cellular phone 6 of the user (step S110). The cellular phone 6 receives the settlement completion notification (step S111), and informs the user of the completion of the settlement by voice, or text, or images on a display (step S112).

When the automatic response to the abnormality has not been set in step S106, the abnormality informing signal, which has been output from the abnormality determining section 32 and includes the vehicle condition data which is the information relating to the abnormality of the vehicle, is transmitted from the on-vehicle phone 8 to the data server 2.

The server communicator 10 of the data server 2 receives the abnormality informing signal which includes the vehicle condition data (step S114). This abnormality informing signal is then stored in the storage section 11 of the data server 2 (step S115), and is transmitted to the cellular phone 6 of the user 3 (step S116).

On receiving the abnormality informing signal (step S117), the cellular phone 6 of the user 3 informs the user 3 of the contents of this information by voice, or text, or images on the display (step S118).

The user then decides the manner to settle the abnormality (step S119), and inputs the manner into the cellular phone 6. Then, the cellular phone 6 transmits the settling command signal to the server communicator 10 of the data server 10.

The server communicator 10 of the data server 2 receives the command signal to settle the abnormality (step S121), and transmits the settling command signal to the on-vehicle phone 8 in the vehicle 1 (step S122).

When the on-vehicle phone 8 receives the settling command signal (step S123), the driver 9 settles the abnormality based on the settling command signal (step S107).

The driver 9, which has completed the settlement of the abnormality, outputs the settlement completion notification, and this settlement completion notification is transmitted from the on-vehicle phone 8 to the data server 2 (step S108). The server communicator 10 of the data server 2 receives the settlement completion notification transmitted from the on-vehicle phone 8 of the on-vehicle unit 4 (step S109), and sends the notification to the cellular phone 6 of the user (step S110). The cellular phone 6 receives the settlement informing notification (step S111), and informs the user of the completion of the settlement by voice, or text, or images on a display (step S112).

The third embodiment of the present invention will now be explained. In the third embodiment, when an abnormality has occurred in the vehicle, the vehicle directly communicates with the user. The outline of the third embodiment is as follows. An on-vehicle sensor detects the conditions of the vehicle, and outputs the vehicle condition data. The vehicle condition data is stored into a storage section in an on-vehicle unit at a predetermined interval. An abnormality determining section of the on-vehicle unit determines whether the abnormality has occurred in the vehicle, based on the vehicle condition data stored in the storage section. When the abnormality is detected, the abnormality determining section outputs an abnormality informing signal. An on-vehicle phone of the on-vehicle unit transmits the abnormality informing signal to a cellular phone of the user.

When an automatic action to settle the abnormality has been set in the setting section of the on-vehicle unit, a driver of the on-vehicle unit automatically settles the abnormality.

When the user wishes to check whether an abnormality has occurred in the vehicle, the user may access the storage section of the on-vehicle unit through the cellular phone of the user, and may read the vehicle condition data stored in the storage section. When the user finds an abnormality in the vehicle, the user can input the instruction to settle the abnormality into the on-vehicle unit. When the abnormality is settled, the on-vehicle unit may notify the user of the completion of the settlement.

Figure 9:
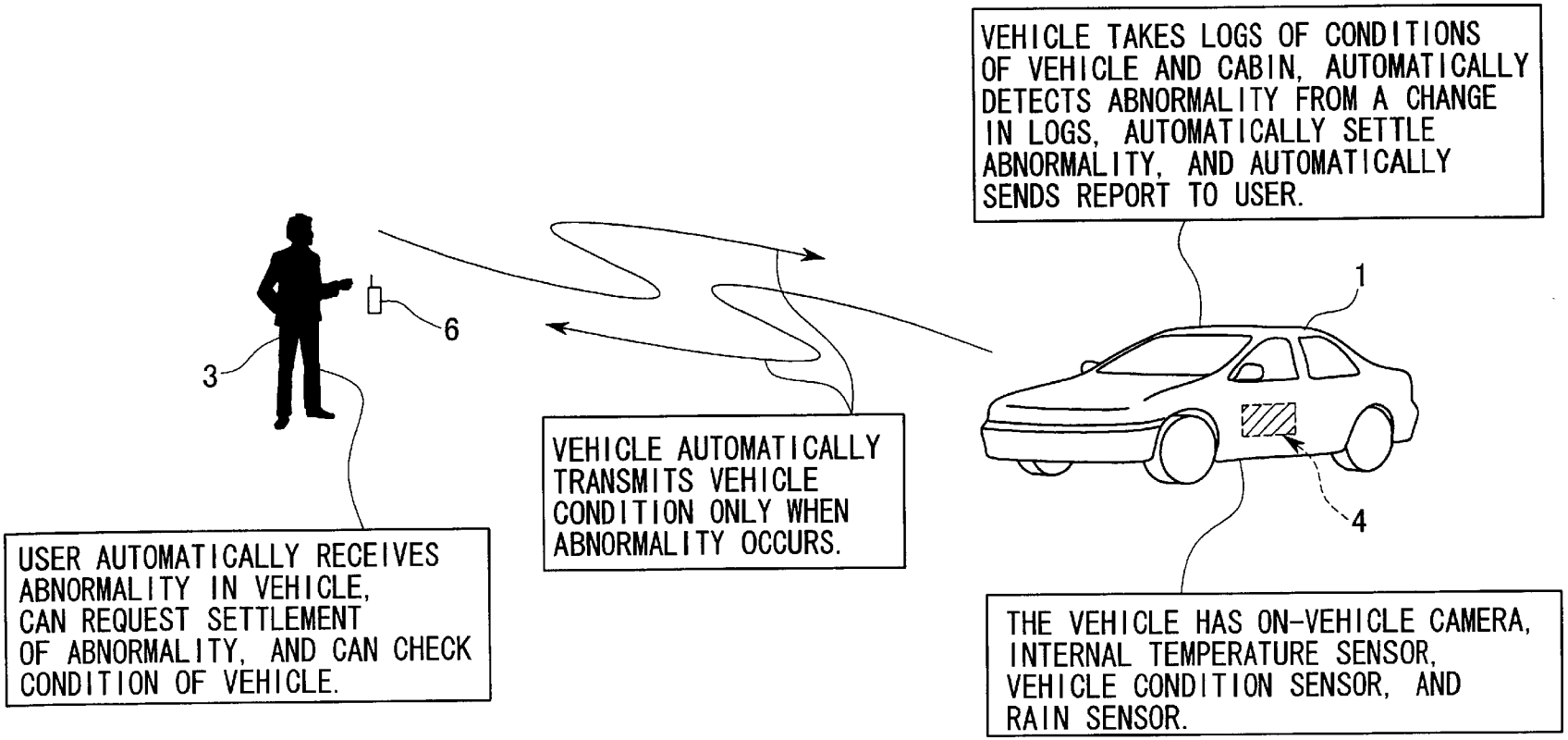
FIG. 9 is a schematic diagram showing the vehicle monitoring system of the third embodiment of the present invention.

FIG. 9 is a diagram schematically showing the vehicle monitoring system of another embodiment. The vehicle monitoring system comprises an on-vehicle unit 4 on the vehicle, and a cellular phone 6 of the user. The on-vehicle unit 4 communicates with the cellular phone 6 only when an abnormality has occurred in the vehicle 1.

Figure 10:
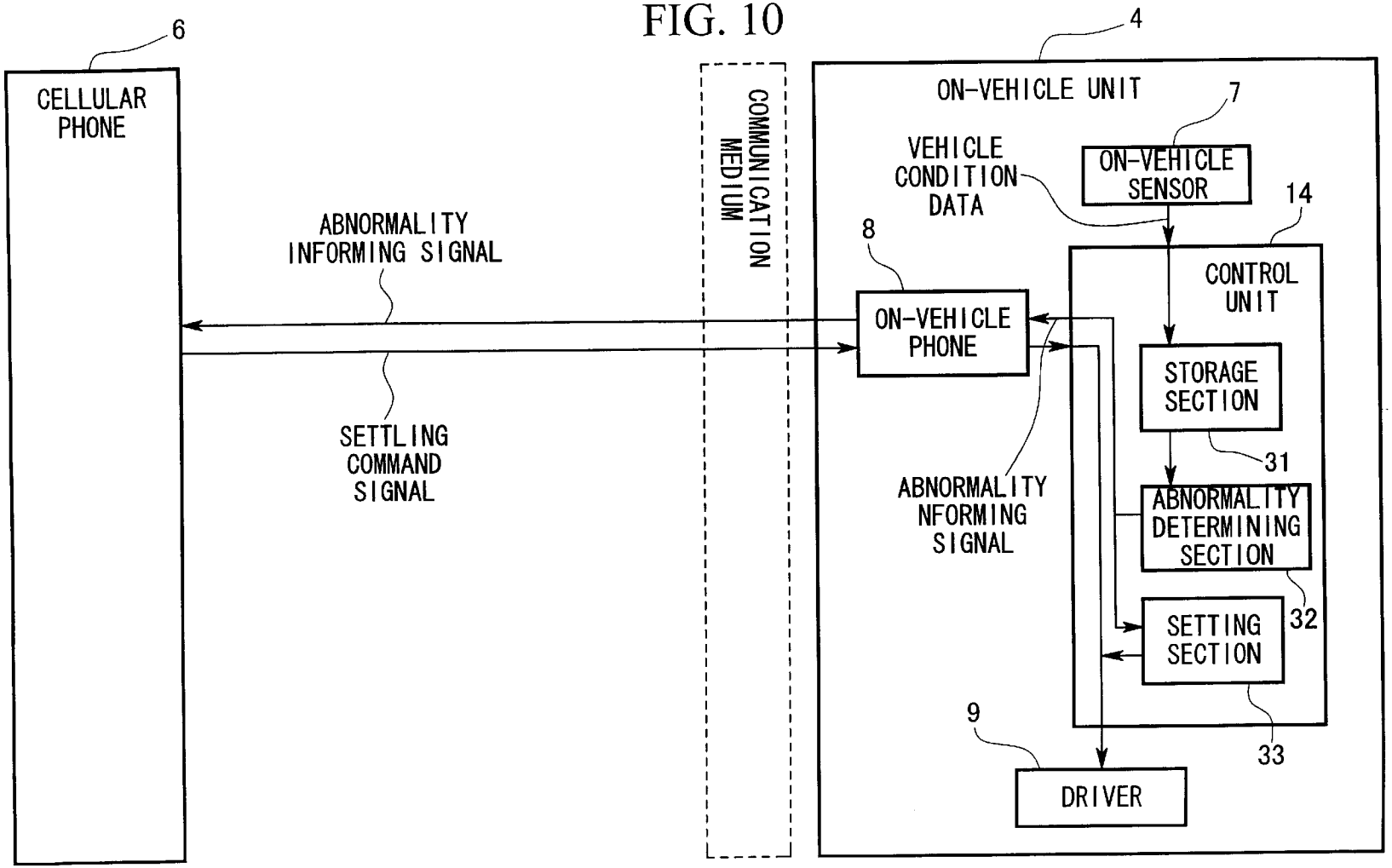
FIG. 10 is a flowchart showing the operation of the second embodiment of the present invention.

FIG. 10 is a diagram showing the vehicle monitoring system in detail, and showing the internal structures of the on-vehicle unit 4 and the cellular phone 6. The difference from the second embodiment is that this embodiment does not use a data server.

Figure 11:
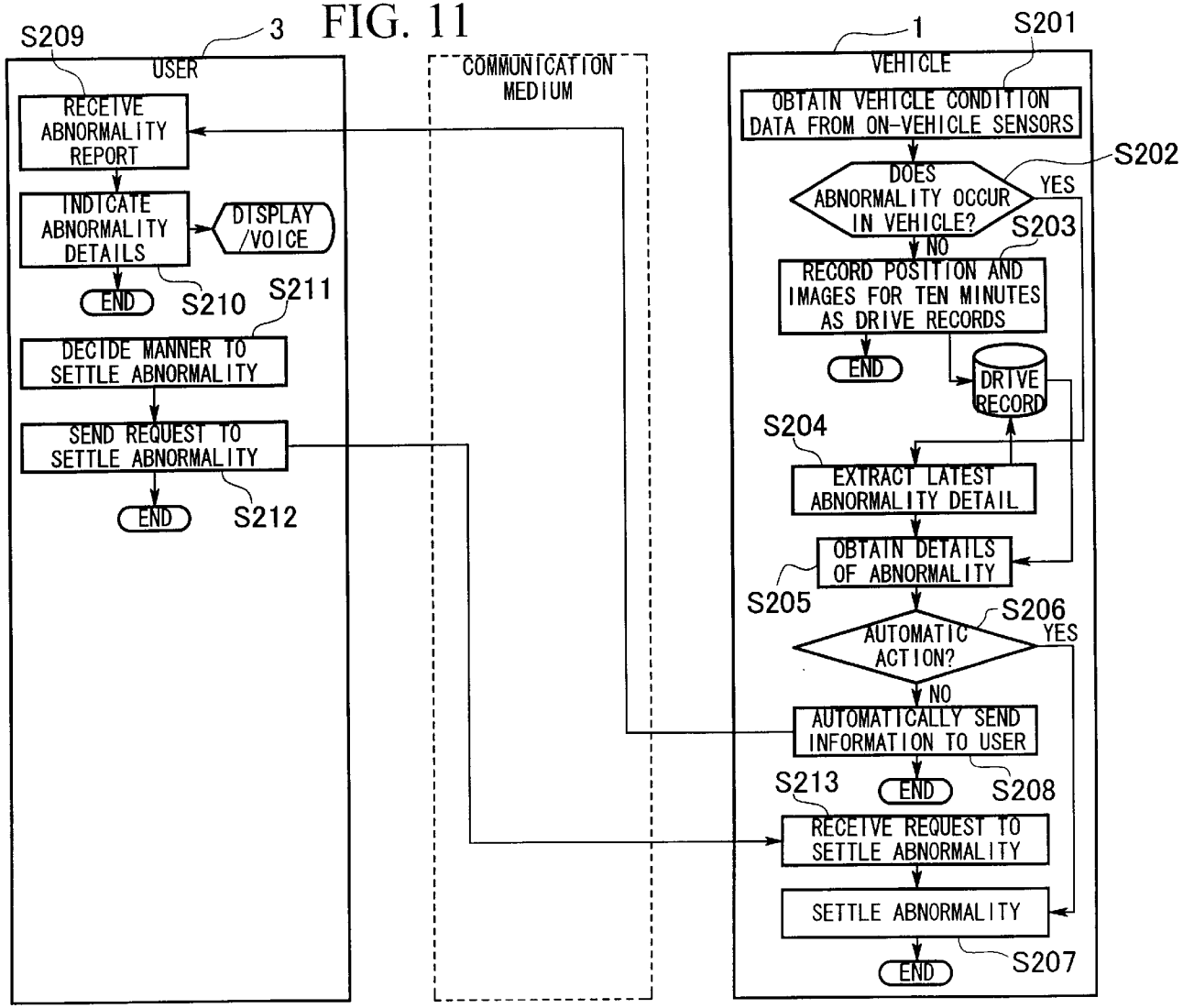
FIG. 11 is a flowchart showing the operation of the third embodiment of the present invention.

The operation of this embodiment will now be explained with reference to the flowchart of FIG. 11. Reference characters such as S201 in the following description denote steps in the flowchart.

An on-vehicle sensor 7 on the vehicle 1 detects the conditions of the vehicle 1 at a predetermined interval, and outputs the vehicle condition data (step S201). Various data units which are the data units representing the conditions of the vehicle obtained by the on-vehicle sensor 7 are input to the control unit 14. The vehicle condition data input to the control unit 14 is stored into a storage section 31 in the control unit 14.

An abnormality determining section 32 of the control unit 14 determines whether an abnormality has occurred in the vehicle 1, based on the vehicle condition data stored in the storage section 31 (step S202).

When no abnormality has occurred in the vehicle, the vehicle condition data is stored in the storage section 31 as a drive record (step S203). The storage section 31 stores the drive records for the previous ten minutes. The drive records include the position of the vehicle 1 and the images inside and outside the vehicle 1.

When the abnormality is detected in the vehicle in step S202, the abnormality determining section 32 requests the storage section 31 to output the stored drive records (step S204). The storage section 31 sends the requested drive records to the abnormality determining section 32, which then determines the details of the abnormality based on the drive records, and then outputs an abnormality informing signal indicating the results of the determination (step S205).

Then, a setting section 33 determines whether an automatic response to the abnormality has been set (step S206). When the automatic response to the abnormality has been set, the setting 33 outputs an abnormality informing signal corresponding to the details of the abnormality determined by the abnormality determining section 32, and sends a settling command signal corresponding to the abnormality informing signal, to a driver 9. The driver 9 settles the abnormality based on the settling command signal (step S207).

When the automatic action to the abnormality has not been set in step S206, the abnormality informing signal, which has been output from the abnormality determining section 32 and includes the vehicle condition data which is the information relating to the abnormality of the vehicle, is transmitted from the on-vehicle phone 8 to the cellular phone 6 (step S207).

The cellular phone 6 of the user 3 receives the abnormality informing signal (step S209), and informs the user 3 of the contents of this information by voice, or text, or images on the display (step S210).

The user 3 then decides the manner to settle the abnormality (step S211), and inputs the manner into the cellular phone 6. Then, the cellular phone 6 transmits a settling command signal to the on-vehicle phone 8 in the vehicle 1 (step S212).

When the on-vehicle phone 8 in the vehicle 1 receives the settling command signal (step S213), a driver 9 settles the abnormality (step S207).

The cellular phone may be another portable communicator such as a portable computer.

This invention may be embodied in other forms or carried out in other ways without departing from the spirit thereof. The present embodiments are therefore to be considered in all respects illustrative and not limiting, the scope of the invention being indicated by the appended claims, and all modifications falling within the meaning and range of equivalency are intended to be embraced therein.

What is claimed is:

1. A vehicle monitoring system comprising:

an on-vehicle unit provided in a vehicle, the on-vehicle unit comprising:

a vehicle condition monitor for monitoring a condition of the vehicle at a predetermined interval and outputting vehicle condition data; and an on-vehicle communicator for sending at another predetermined interval the vehicle condition data output from the vehicle condition monitor;

a data server for communicating with the on-vehicle unit, the data server comprising:

a server communicator for receiving the vehicle condition data sent from the on-vehicle communicator;

a storage section for storing the vehicle condition data from a predetermined past time to the present;

an abnormality determining section for determining whether an abnormality has occurred in the vehicle, based on the vehicle condition data stored in the storage section, and for outputting an abnormality informing signal when the abnormality has occurred in the vehicle; and a portable communicator for communicating with the data server, wherein the server communicator sends the abnormality informing signal output from the abnormality determining section, to the portable communicator and wherein the vehicle condition data includes conditions inside the vehicle as well as conditions outside the vehicle, and wherein in an emergency condition, the on-vehicle communicator sends emergency information to the data server regardless of the another predetermined interval.

2. A vehicle monitoring system according to claim 1, wherein the storage section and the abnormality determining section are provided in the on-vehicle unit.

3. A vehicle monitoring system according to claim 1, wherein the storage section and the abnormality determining section are provided in the data server.

4. A vehicle monitoring system according to claim 3 or 1, wherein in response to a data request signal from the portable communicator to request sending of the vehicle condition data, the server communicator or the on-vehicle communicator sends the vehicle condition data from the storage section to the portable communicator.

5. A vehicle monitoring system according to claim 3 or 1, further comprising:

a driver for driving a part of the vehicle, wherein the portable communicator sends a settling command signal to settle the abnormality to the driver, and the driver drives the part of the vehicle based on the sent settling command signal.

6. A vehicle monitoring system according to claim 5, further comprising:

a setting section for setting a command to settle the abnormality, in advance, wherein the setting section sends a settling command signal corresponding to the abnormality informing signal sent from the abnormality determining section, through the server communicator to the on-vehicle communicator.

7. A vehicle monitoring system comprising:

an on-vehicle unit provided in a vehicle; and a data server for communicating with the on-vehicle unit, wherein the on-vehicle unit comprises:

a vehicle condition monitor for monitoring a condition of the vehicle at a predetermined interval and outputting vehicle condition data; and an on-vehicle communicator for sending at another predetermined interval the vehicle condition data output from the vehicle condition monitor, to the data server, and the data server comprises:

a server communicator for receiving the vehicle condition data sent from the on-vehicle communicator;

a storage section for storing the vehicle condition data, from a predetermined past time to the present, received by the server communicator; and an abnormality determining section for determining whether an abnormality has occurred in the vehicle, based on the vehicle condition data stored in the storage section, and for outputting an abnormality informing signal when the abnormality has occurred in the vehicle; and a portable communicator for communicating with the data server, wherein the server communicator sends the abnormality informing signal output from the abnormality determining section, to the portable communicator and wherein the vehicle condition data includes conditions inside the vehicle as well as conditions outside the vehicle, and wherein in an emergency condition, the on-vehicle communicator sends emergency information to the data server regardless of the another predetermined interval.

8. A vehicle monitoring system according to claim 7, wherein in response to a data request signal from the portable communicator to request sending of the vehicle condition data, the server communicator sends the vehicle condition data from the storage section to the portable communicator.

9. A vehicle monitoring system according to claim 7,further comprising:

a driver for driving a part of the vehicle, wherein the portable communicator sends a settling command signal to settle the abnormality through the server communicator and the on-vehicle communicator to the driver, and the driver drives the part of the vehicle based on the sent settling command signal.

10. A vehicle monitoring system according to claim 9, further comprising:

a setting section for setting a command to settle the abnormality, in advance, wherein the setting section sends a settling command signal corresponding to the abnormality informing signal sent from the abnormality determining section, through the server communicator to the on-vehicle communicator.

11. A vehicle monitoring system comprising:

an on-vehicle unit provided in a vehicle; comprises a data server for communicating with the on-vehicle unit, the data server, comprising:

a vehicle condition monitor for monitoring a condition of the vehicle at a predetermined interval and outputting vehicle condition data; and an on-vehicle communicator for sending at an predetermined interval the vehicle condition data output from the vehicle condition monitor;

a driver for driving a part of the vehicle;

a server communicator for communicating with the on-vehicle unit and with a portable communicator;

a storage section for storing the vehicle condition data, from a predetermined past time to the present, output from the vehicle condition monitor;

an abnormality determining section for determining whether an abnormality has occurred in the vehicle, based on the vehicle condition data stored in the storage section, and for outputting an abnormality informing signal when the abnormality has occurred in the vehicle; and an on-vehicle communicator for sending at another predetermined interval the abnormality informing signal output from the abnormality determining section to the data server, and the data server further comprising:

a server communicator for receiving the vehicle condition data sent from the on-vehicle communicator; and a portable communicator for communicating with the data server, wherein the server communicator sends the abnormality informing signal output from the on-vehicle communicator to the portable communicator and wherein the vehicle condition data includes conditions inside the vehicle as well as conditions outside the vehicle, and wherein in an emergency condition, the on-vehicle communicator sends emergency information to the data server regardless of the predetermined interval.

12. A vehicle monitoring system according to claim 11, wherein in response to a data request signal from the portable communicator to request sending of the vehicle condition data, the server communicator sends the data request signal to the on-vehicle communicator, the on-vehicle communicator sends the vehicle condition data from the storage section through the server communicator to the portable communicator in response to the data request signal.

13. A vehicle monitoring system according to claim 11, further comprising:

a driver for driving a part of the vehicle, wherein the portable communicator sends a settling command signal to settle the abnormality, through the server communicator and the on-vehicle communicator to the driver, and the driver drives the part of the vehicle based on the sent settling command signal.

14. A vehicle monitoring system according to claim 13, further comprising:

a setting section for setting a command to settle the abnormality, in advance, wherein the setting section sends a settling command signal corresponding to the abnormality informing signal sent from the abnormality determining section, communicator to the driver.

* * * * *